US008950126B2

(12) United States Patent
Imai et al.

(10) Patent No.: US 8,950,126 B2
(45) Date of Patent: Feb. 10, 2015

(54) WOODEN BUILDING SKELETON

(71) Applicant: Sumitomo Forestry Co., Ltd., Tokyo (JP)

(72) Inventors: Junichi Imai, Tokyo (JP); Hiroki Ishiyama, Tokyo (JP); Hiroki Nakashima, Tokyo (JP)

(73) Assignee: Sumitomo Forestry Co., Ltd., Tokyo (JP)

( * ) Notice: Subject to any disclaimer, the term of this patent is extended or adjusted under 35 U.S.C. 154(b) by 0 days.

(21) Appl. No.: 13/793,360

(22) Filed: Mar. 11, 2013

(65) Prior Publication Data

US 2014/0090315 A1 Apr. 3, 2014

(30) Foreign Application Priority Data

Mar. 12, 2012 (JP) ..... 2012-055054

(51) Int. Cl.
*E04B 1/98* (2006.01)
*E04B 1/49* (2006.01)

(52) U.S. Cl.
CPC .... *E04B 1/49* (2013.01); *E04B 1/98* (2013.01)
USPC ..... 52/167.4; 52/299; 52/764

(58) Field of Classification Search
USPC ..... 52/167.1, 167.3, 167.4, 79.12, 79.13, 52/295, 293.3, 299, 712, 764, 474
See application file for complete search history.

(56) References Cited

U.S. PATENT DOCUMENTS 2,011,312 A * 8/1935 Engman ..... 52/223.13
3,638,377 A * 2/1972 Caspe ..... 52/167.4
4,321,776 A * 3/1982 Delight ..... 52/167.1
4,875,314 A * 10/1989 Boilen ..... 52/167.1
5,666,781 A * 9/1997 Egawa et al. ..... 52/747.1
5,675,943 A * 10/1997 Southworth ..... 52/167.1
5,921,042 A * 7/1999 Ashton et al. ..... 52/291
6,006,487 A * 12/1999 Leek ..... 52/698
6,014,843 A * 1/2000 Crumley et al. ..... 52/167.3
6,067,769 A * 5/2000 Hardy ..... 52/693

(Continued)

FOREIGN PATENT DOCUMENTS

JP 200492150 A 3/2004
JP 2006118275 A 5/2006

(Continued)

OTHER PUBLICATIONS

Machine Translation of JP 2006-118275.*

*Primary Examiner* — James Ference
(74) *Attorney, Agent, or Firm* — The Webb Law Firm

(57) ABSTRACT

The wooden building skeleton of the present invention has excellent quake resistance because the column of a rigid-frame structure joined to a cross member or the foundation so that a bending moment can be transferred therebetween and the load-bearing wall therein exhibit their load bearing ability. A foundation and a wooden column and the wooden column and a beam are respectively joined by two bolts so that a bending moment can be transferred therebetween. A load-bearing wall is also provided between the beam and the foundation. The length of the section of the bolts which undergoes elongation when inter-story deflection occurs between the beam and the foundation or the cross-sectional dimensions of the wooden column is set such that the inter-story deflection which is generated before the wooden column is fractured is almost equal to or greater than the inter-story deflection which is generated before the load-bearing wall is fractured.

7 Claims, 14 Drawing Sheets

(56) References Cited

U.S. PATENT DOCUMENTS

| | | | | |
|---|---|---|---|---|
| 6,141,928 | A * | 11/2000 | Platt | 52/296 |
| 6,148,583 | A * | 11/2000 | Hardy | 52/693 |
| 6,158,184 | A * | 12/2000 | Timmerman et al. | 52/293.3 |
| 6,298,612 | B1 * | 10/2001 | Adams | 52/167.3 |
| 6,308,469 | B1 * | 10/2001 | Leung | 52/167.3 |
| 6,327,831 | B1 * | 12/2001 | Leek | 52/698 |
| 6,389,767 | B1 * | 5/2002 | Lucey et al. | 52/295 |
| 6,453,634 | B1 * | 9/2002 | Pryor | 52/713 |
| 6,513,290 | B2 * | 2/2003 | Leek | 52/295 |
| 6,550,200 | B1 * | 4/2003 | Mueller | 52/296 |
| 6,560,940 | B2 * | 5/2003 | Mueller | 52/295 |
| 6,625,945 | B2 * | 9/2003 | Commins | 52/293.3 |
| 6,643,986 | B2 * | 11/2003 | Commins et al. | 52/483.1 |
| 6,668,508 | B2 * | 12/2003 | Boone et al. | 52/645 |
| 7,007,432 | B2 * | 3/2006 | Commins | 52/293.3 |
| 7,073,298 | B1 * | 7/2006 | Phan | 52/223.7 |
| 7,150,132 | B2 * | 12/2006 | Commins | 52/293.3 |
| 7,251,920 | B2 * | 8/2007 | Timmerman et al. | 52/800.13 |
| 7,712,282 | B2 * | 5/2010 | Robertson et al. | 52/712 |
| 2001/0002529 | A1 * | 6/2001 | Commins et al. | 52/481.1 |
| 2002/0002806 | A1 * | 1/2002 | Commins et al. | 52/481.1 |
| 2003/0009964 | A1 * | 1/2003 | Trarup et al. | 52/295 |
| 2003/0136075 | A1 * | 7/2003 | Brackett | 52/712 |
| 2003/0230032 | A1 * | 12/2003 | Shahnazarian et al. | 52/167.3 |
| 2004/0068947 | A1 * | 4/2004 | Commins et al. | 52/293.3 |
| 2005/0126105 | A1 * | 6/2005 | Leek et al. | 52/633 |
| 2005/0193681 | A1 * | 9/2005 | Brackett | 52/698 |
| 2005/0284073 | A1 * | 12/2005 | Leek et al. | 52/580 |
| 2006/0037256 | A1 * | 2/2006 | Pryor | 52/167.1 |
| 2007/0022704 | A1 * | 2/2007 | Pryor | 52/712 |
| 2007/0062135 | A1 * | 3/2007 | Mueller | 52/293.3 |
| 2007/0110513 | A1 * | 5/2007 | Fujihashi et al. | 403/364 |
| 2010/0186316 | A1 * | 7/2010 | Buchanan et al. | 52/167.1 |
| 2010/0229495 | A1 * | 9/2010 | Gridley et al. | 52/705 |
| 2014/0090315 | A1 * | 4/2014 | Imai et al. | 52/167.1 |
| 2014/0090317 | A1 * | 4/2014 | Nakashima et al. | 52/223.8 |
| 2014/0093306 | A1 * | 4/2014 | Imai et al. | 403/180 |

FOREIGN PATENT DOCUMENTS

| | | | |
|---|---|---|---|
| JP | 2006225967 | A | 8/2006 |
| JP | 2006307568 | A | 11/2006 |
| JP | 200777611 | A | 3/2007 |

* cited by examiner

WOODEN BUILDING SKELETON

BACKGROUND OF THE INVENTION

1. Technical Field

The present invention relates to a wooden building skeleton composed of wooden columns, beams, load-bearing walls and so on which resist a horizontal force, and, more particularly, to a wooden building skeleton including a column having an upper or lower end joined to a cross member, such as a beam, or the foundation in such a way that a bending moment can be transferred therebetween.

2. Related Art

Many of wooden buildings constituted of columns and cross members, such as beams, have load-bearing walls formed by providing braces between columns or load-bearing walls formed by securing facing materials between columns to form a framework structure which resists horizontal forces during an earthquake or the like. In such a structure, the columns on both sides of a load-bearing wall serve as shaft columns which do not transfer and receive a bending moment to and from a cross member, such as a beam, base or girt, and supports a beam or the like mainly by means of an axial force, and braces or facing materials constrain the shaft columns from tilting.

On the other hand, it is proposed to introduce a rigid-frame structure in which columns and cross members, such as beams, are joined in such a way that a bending moment can be transferred therebetween as a structure different from the framework structure also into wooden buildings as disclosed in Patent Literature 1, for example. A rigid-frame structure facilitates the creation of a residential space with few columns and the formation of a large opening in exterior walls. In such a rigid-frame structure, horizontal forces during an earthquake or the like are resisted by the bending rigidity of columns and the bending rigidity of cross members or the like joined to the columns in such a way that a bending moment can be transferred therebetween.

When a wooden building with a structural skeleton having a rigid-frame structure as described above is constructed, shaft columns are usually installed, in addition to the columns forming the rigid-frame structure, beneath the beams to form additional exterior walls or partition walls. Patent Literature 2 discloses the use of such exterior walls or partition walls as load-bearing walls which form a part of the structural skeleton. When exterior walls or partition wall can serve to resist horizontal forces during an earthquake or the like, a highly economical structure may be achieved because the number of columns having a rigid-frame structure can be reduced.

[Patent Literature 1] JPA-Publication No. 2004-92150

[Patent Literature 2] JPA-Publication No. 2006-118275

However, a column or beam having a rigid-frame structure and a load-bearing wall using a facing material are completely different in the mechanism involved in resisting a horizontal force and exhibits different deformational characteristics when subjected to a horizontal force. In particular, the amount of inter-story deflection, in other words, the horizontal relative displacement in the axial direction of a beam supported by a column between the beam and the foundation or a beam of the lower story, before a column or load-bearing wall loses its load bearing ability may be completely different. When there is such a difference in characteristics, when horizontal forces, such as forces generated by earthquake motion, are repeatedly applied, functional deterioration may occur in a part of the structural skeleton earlier than in the other parts. Then, the ability to absorb the energy of earthquake motion repeatedly applied may decrease.

The present invention has been made in view of the above circumstances, and it is, therefore, an object of the present invention to provide a wooden building skeleton which has excellent quake resistance because a column having a rigid-frame structure and joined to a cross member or foundation in such a way that a bending moment can be transferred therebetween and a load-bearing wall therein fully exhibit their load bearing ability and ability to absorb vibrational energy.

SUMMARY OF THE INVENTION

To solve the problem, the invention according to Aspect 1 provides a wooden building skeleton, comprising: a wooden column erected on a foundation or a beam of the lower story, the wooden column having a flat rectangular cross-section; a wooden beam joined to the wooden column with a lower surface thereof facing an upper surface of the wooden column, the wooden beam having an axis extending in a direction of a long axis of the cross-section of the wooden column; and a load-bearing wall having two shaft columns erected at a predetermined distance on the foundation or the beam of the lower story for supporting the wooden beam by means of an axial force, and a board member secured to the shaft columns or a plurality of board members, each of the plurality of board members having a predetermined width and being secured to the shaft columns at both ends and arranged obliquely between the shaft columns; wherein the wooden column has a lower end joined to the foundation or the beam of the lower story via two first bolts positioned vertically in the vicinity of both ends of the cross-section of the wooden column in a direction of the long axis of the cross section in such a way that a bending moment can be transferred from the wooden column to the foundation or the beam of the lower story; the wooden column and the wooden beam are joined to each other via two second bolts positioned vertically in the vicinity of both ends of the cross-section of the wooden column in the direction of the long axis of the cross-section in such a way that a bending moment can be transferred between the wooden beam and the wooden column; and a length of a section of the first bolts and a length of a section of the second bolts which undergo elongation when relative displacement in the axial direction of the wooden beam is generated between the wooden beam and the foundation or the beam of the lower story and a dimension of the wooden column in the direction of the long axis of the cross-section of the wooden column are set such that the relative displacement which is generated before the wooden column is fractured is almost equal to or greater than the relative displacement which is generated before the load-bearing wall is fractured.

In this wooden building skeleton, when a horizontal force is applied, horizontal relative displacement in the axial direction of the wooden beam between the wooden beam and foundation or the beam of the lower story, in other words, inter-story deflection, occurs. In the part where the wooden column joined to the foundation or the beam in such a way that a bending moment can be transferred therebetween, in other words, a column having a rigid-frame structure, is installed, bending deformation of the column itself and a change in angle at the joint between the column and the beam or the joint between the column and the foundation, in other words, deformation of joints, occur when the inter-story deflection occurs. The change in the angle between the wooden column and the wooden beam or the foundation is caused because one of the two bolts at each joint undergoes elongation and a compressive force is applied to the column in the vicinity of the other bolt. The deformation performance of such a joint largely depends on the length of the bolts; the deformation amount which is allowed before the bolts are broken decreases as the bolts are shorter and the deformation amount which is allowed before the bolts are broken increases as the bolts are longer. In addition, as the dimension of the wooden column in the direction of the long axis of the cross-section thereof is smaller, bending deformation is easier to occur in the wooden column and the inter-story deflection before fracture increases.

On the other hand, in the load-bearing wall having a board member secured to two shaft columns, the board member undergoes deformation and is deformed in the vicinity of the attaching members such as nails or screws used to attach the board member to the shaft columns.

In the wooden building skeleton according to the invention of Aspect 1, because the inter-story displacement before the wooden column is fractured and the inter-story displacement before the load-bearing wall is fractured are almost equal to each other, both the wooden column and the load-bearing wall maintain their load bearing ability in a plastically deformed state until they are fractured and exhibit the load bearing performance effectively to resist a horizontal force which is repeatedly applied during an earthquake. In addition, because the inter-story deflection which occurs before the wooden column is fractured is greater than the inter-story deflection which occurs before the load-bearing wall is fractured, the energy of earthquake motion which is repeatedly applied can be effectively absorbed by the plastic deformation of the bolts until the structural skeleton is fractured.

The invention according to Aspect 2 is the wooden building skeleton according to Aspect 1, wherein the section which undergoes elongation of the second bolts used to join an upper end of the wooden column and the wooden beam are set to have a longer length or smaller diameter than the section which undergoes elongation of the first bolts used to join the lower end of the wooden column and the foundation.

When a horizontal force is applied during an earthquake, the lower end of the column erected on the foundation is constrained on the foundation and the foundation is hardly deformed. In contrast, the upper end of the column is deformed together with the beam joined thereto and the beam receives a bending moment.

In the wooden building skeleton, the second bolts can be elongated more easily than the first bolts so that the joint between the wooden column and the beam can be deformed more easily. Thus, when a horizontal force is applied, the constraint on the joint between the upper end of the column and the beam is eased to reduce the bending moment which acts on the beam and the bending deformation of the beam.

The invention according to Aspect 3 is the wooden building skeleton according to Aspect 1 or 2, wherein screw members having a spiral blade on a cylindrical outer periphery thereof are axially threaded into the upper end and the lower end of the wooden column at locations in the vicinity of both ends of the cross-section of the wooden column in the direction of the long axis of the cross-section; the screw members have a hole axially extending from an end face thereof; the first bolts and the second bolts are inserted into the holes and each of the bolts has a proximal end threadedly engaged with a female thread formed in the vicinity of the bottom of the holes; each of the first bolts and the second bolts has a distal end engaged with a joint device secured to the foundation or the beam of the lower story or a joint device secured to the wooden beam; the first bolts and the second bolts undergo the elongation between the distal end and the proximal end threadedly engaged with the female thread in the hole; and the female thread with which the proximal end of each of the first bolts and the second bolts is threadedly engaged is located at approximately half the axial length of the screw member.

In the wooden building skeleton, the wooden column is joined to the beam or the foundation by bolts inserted into the through holes of the screw members axially threaded into the wooden column and threadedly engaged with the bottoms of the through holes. Thus, the section of the bolts which undergoes elongation can be changed by changing the depth of the through holes extending axially through the screw members to change the deformation amount before the joint between the wooden column and the beam is fractured. In addition, because the female threads with which the proximal ends of the bolts are threadedly engaged are located at approximately half the axial length of the screw members, the force transferred from the blades of the screw members to the wooden column is distributed to a wide range in the axial direction of the screw members, and large stress is prevented from being concentrated on the wooden column.

The invention according to Aspect 4 is the wooden building skeleton according to any one of Aspects 1 to 3, wherein the number of nails or screws used to fix the board member or the plurality of obliquely-arranged board members with a predetermined width of the load-bearing wall to the shaft columns is set such that the load-bearing wall has an equivalent bearing ability as the wooden column when the relative displacement is generated between the wooden beam and the foundation or the beam of the lower story.

The load-bearing wall having a board member secured between the two shaft columns or the load-bearing wall having a plurality of board members arranged obliquely between the shaft columns has different deformation performance depending on the number or pitch of the nails or screws used to attach the board member or the plurality of board members to the shaft columns. In other words, as the number is increased or the pitch is decreased, the load-bearing wall has higher rigidity, and the inter-story deflection decreases compared to when the number is smaller or the pitch is larger even when the same horizontal force is applied. In addition, when the number is smaller or the pitch is larger, the load-bearing wall has lower rigidity and the inter-story deflection is larger even when the same horizontal force is applied.

In addition, when the number is larger or the pitch is smaller, the load-bearing wall has higher load bearing ability and the horizontal force which is applied to the load-bearing wall when the amount of inter-story deflection in response to a horizontal force reaches a plastic zone is larger.

As described above, the load-bearing wall and the wooden column having a rigid-frame structure can be set to provide generally the same amount of inter-story deflection when the same horizontal force is applied thereto by adjusting the number or pitch of the nails or screws used to attach the board member or the plurality of board members of the load-bearing wall. In addition, the difference between the horizontal forces which are applied to the load-bearing wall and the wooden column having a rigid-frame structure when large inter-story deflection occurs because a horizontal force is repeatedly applied during an earthquake can be decreased. Thus, the force is prevented from being concentrated on either the load-bearing wall or the wooden column having a rigid-frame structure by the effect of a horizontal force.

As described above, the wooden building skeleton of the present invention has excellent quake resistance because the column of a rigid-frame structure joined to a cross member or the foundation in such a way that a bending moment can be transferred therebetween and the load-bearing wall therein fully exhibit their load bearing ability.

This application is based on the Patent Applications No. 2012-055054 filed on Mar. 12, 2012 in Japan, the contents of which are hereby incorporated in its entirety by reference into the present application, as part thereof.

The present invention will become more fully understood from the detailed description given hereinbelow. The other applicable fields will become apparent with reference to the detailed description given hereinbelow. However, the detailed description and the specific embodiment are illustrated of desired embodiments of the present invention and are described only for the purpose of explanation. Various changes and modifications will be apparent to those ordinary skilled in the art on the basis of the detailed description.

The applicant has no intention to give to public any disclosed embodiments. Among the disclosed changes and modifications, those which may not literally fall within the scope of the patent claims constitute, therefore, a part of the present invention in the sense of doctrine of equivalents.

BRIEF DESCRIPTION OF THE DRAWINGS

FIG. 7 is a schematic view, illustrating the deformation of the column and deformation of the joint between the column and the foundation and the joint between the column and the beam when a horizontal force is applied because of an earthquake or the like.

DETAILED DESCRIPTION OF THE PREFERRED EMBODIMENT

Description is hereinafter made of an embodiment of the present invention with reference to the drawings.

Figure 1:
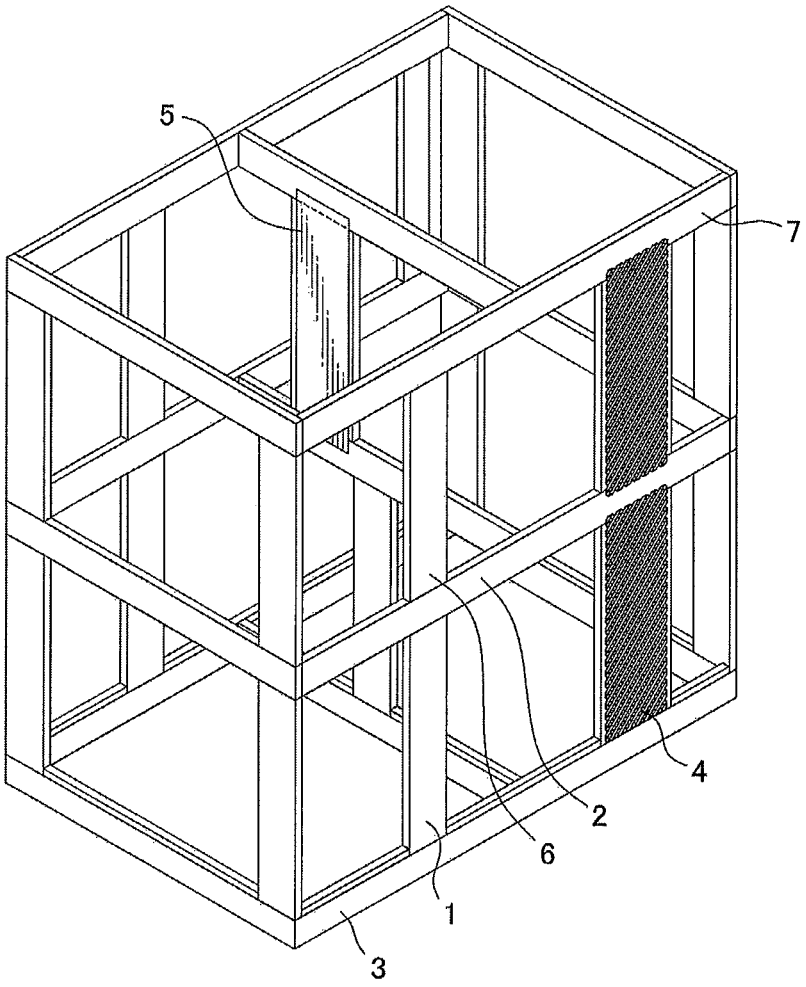
FIG. 1 is a schematic perspective view, illustrating a wooden building skeleton according to one embodiment of the present invention.

FIG. 1 is a schematic perspective view illustrating a wooden building skeleton according to an embodiment of the present invention.

The structural skeleton has an essential portion constituted of a rigid-frame structural body formed by joining a wooden column 1 and a wooden beam 2 in such a way that a bending moment can be transferred therebetween, and is formed by combining a plurality of rigid-frame structural bodies on a concrete foundation 3. Each rigid-frame structural body has what is called a beam-priority structure in which a wooden beam 2 is mounted on and joined to a wooden column 1. A part of the rigid-frame structural body has load-bearing walls 4 and 5 each formed by securing a panel-like member to two shaft columns supporting the beam 2 in addition to the column 1 having a rigid-frame structure and capable of transferring and receiving a bending moment to and from a beam.

The column 1 of each rigid-frame structural body has a flat cross-sectional shape which is long in the axial direction of the beam 2 and short in the direction perpendicular to the axial direction of the beam 2. The beam 2 has a flat cross-sectional shape which is long in a vertical direction and short in a horizontal direction. Therefore, the joint between the column and beam of each rigid-frame structural body has a structure which resists bending in one direction which produces compressive stress and tensile stress in the direction of the long side of the cross-section.

Figure 2:
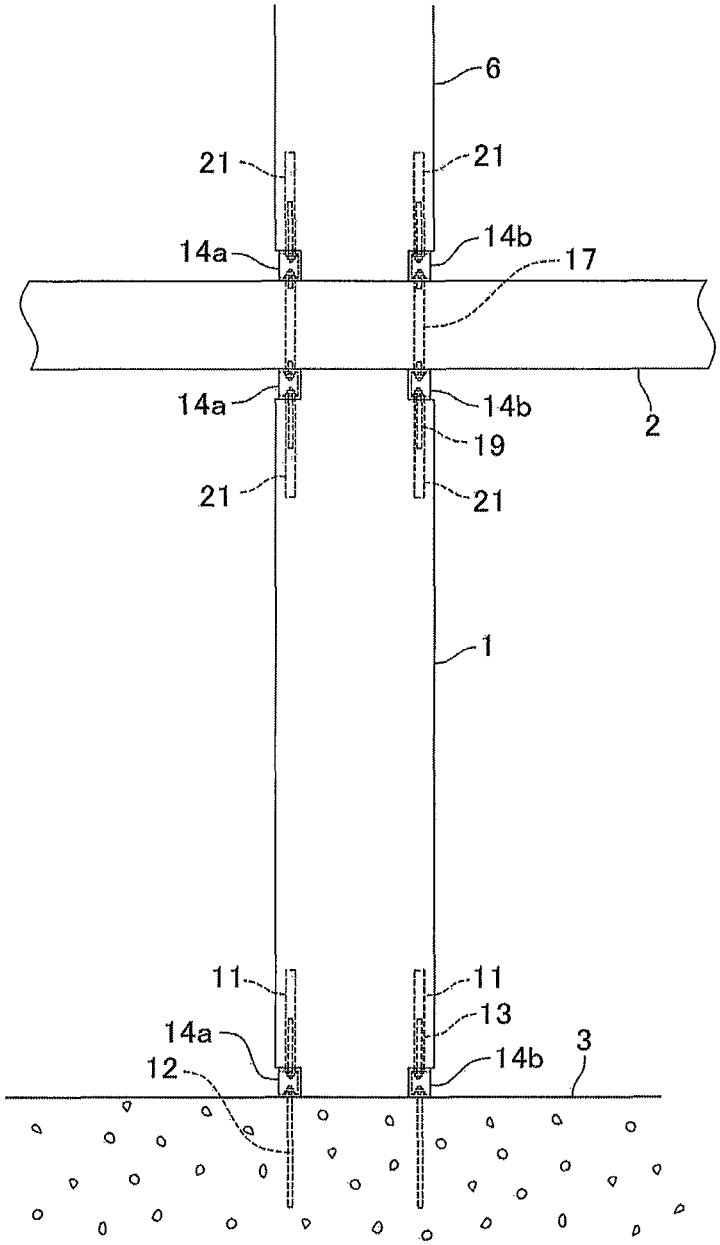
FIG. 2 is a schematic side view, illustrating joint structures between the foundation and a column, between a column and a beam, and between a beam and a column of the upper story in the wooden building skeleton shown in FIG. 1.
Figure 3:
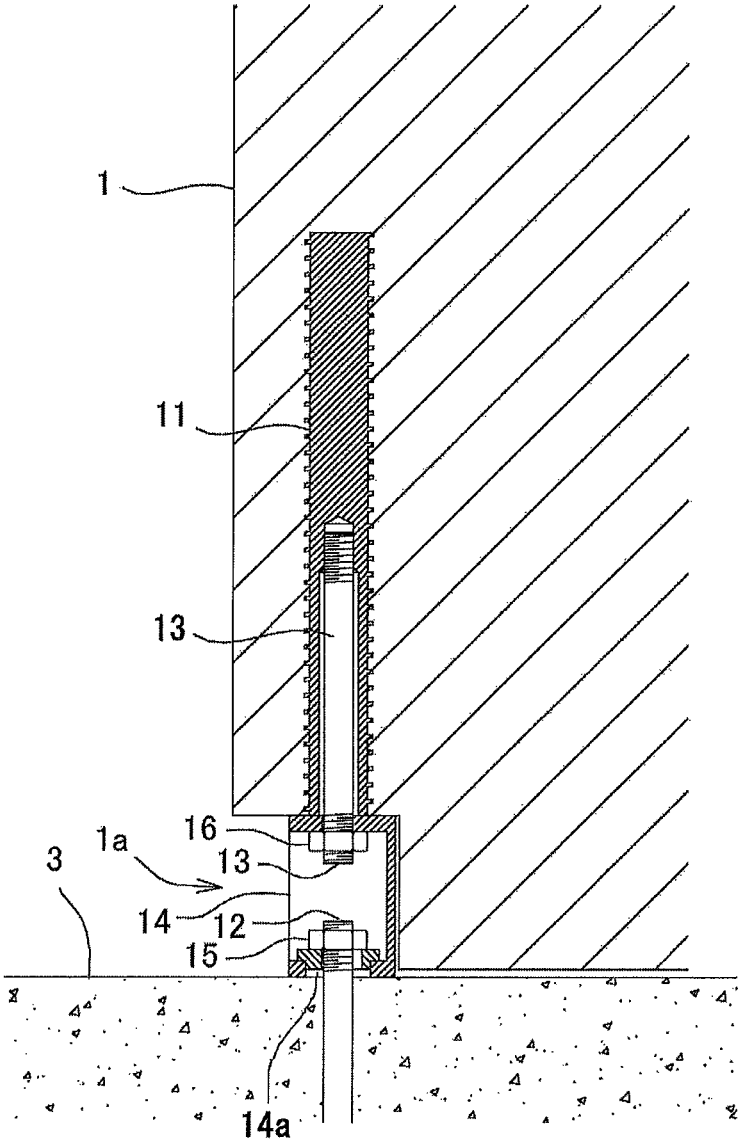
FIG. 3 is an enlarged cross-sectional view, illustrating the joint between the foundation and the column in the wooden building skeleton shown in FIG. 1.

FIG. 2 is a schematic side view illustrating a joint structure between the foundation 3 and the column 1, the joint structure between the column 1 and the beam 2, and the joint structure between the beam 2 and a column 6 of the upper story used in the wooden building skeleton shown in FIG. 1. FIG. 3 is an enlarged cross-sectional view of the joint structure between the foundation 3 and the column 1.

In these joint structures, both ends of the column 1 in the long side direction of the cross-section thereof are connected to the beam 2 or the foundation 3 via metal joint devices 14*a* and 14*b*. Thus, the bending moment generated in the column 1 by a horizontal force is transferred to the foundation 3 or the beam 2 by a tensile force which acts on the part connected by one joint device 14*a* and a compressive force which acts on the part connected by the other joint device 14*b* or a wooden part in the vicinity of the connected part.

The joint devices 14*a* and 14*b* are installed in cutouts 1*a* formed in upper and lower ends of the column 1, and the cutouts 1*a* are provided at both ends of the column 1 in the long side direction of the cross-section thereof. A screw member 11 is axially threaded into the column 1 from the horizontal face of each cutout 1*a*, and the screw member 11 and a corresponding joint device 14 is coupled by a bolt 13.

On the other hand, anchor bolts 12 are vertically embedded in the foundation 3 at positions corresponding to the positions where the screw members 11 are threaded into the column 1 with their heads protruded from the upper surface of the foundation 3. The joint devices 14 are secured to the foundation 3 by nuts 15 threadably mounted on the anchor bolts 12. As a result, the foundation 3 and the column 1 are joined to each other via the anchor bolts 12, the joint devices 14, the bolts 13 and the screw members 11.

Figure 4A:
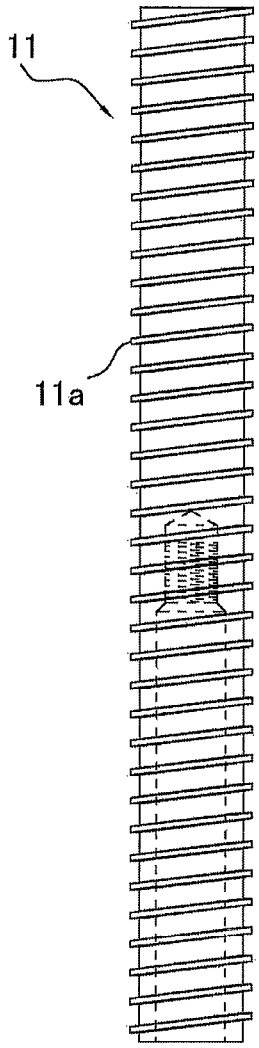
FIG. 4A shows a side view of a screw member that is used to join the column and a foundation shown in FIG. 3.
Figure 4B:
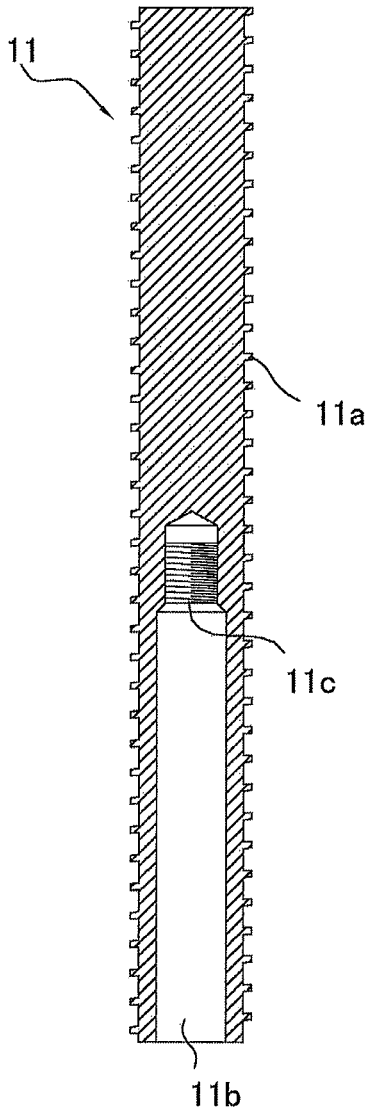
FIG. 4B shows a cross-sectional view of a screw member that is used to join the column and a foundation shown in FIG. 3.

As shown in FIG. 4, the screw member 11 is a rod-like steel member having a spiral protrusion 11*a* on its periphery. When the screw member 11 is threaded into a wooden member, the protrusion 11*a* is engaged with the wooden member and forces in the axial direction of the screw member 11 and in a direction perpendicular to the axial direction are transferred between the screw member 11 and the wooden member. The screw member 11 has a (hollow) through hole 11*b* extending axially from an end face thereof, and a female thread 11*c* is formed at the bottom of the through hole 11*b*. The end of the bolt 13 inserted into the through hole 11*b* is threadedly engaged with the female thread 11*c*.

The bolt 13 has male threads at both ends, and one end of the bolt 13 is inserted into the through hole 11*b* of the screw member 11 and threadedly engaged with the female thread 11*c* at the bottom of the through hole 11*b*. The other end of the bolt 13 is locked to a corresponding joint device 14 by a nut 16 threadably mounted thereon. The portion of the bolt 13 between the male thread portions at both ends has an outside diameter smaller than the inside diameter of the through hole 11*b* of the screw member so that the portion can be separated from the inner peripheral surface of the through hole 11*b* and expansion and contraction of the bolt 13 cannot be constrained.

The bolt 13 is preferably formed of a material which exhibits large plastic deformation before fracture, such as soft steel, and the material, diameter, length and so on thereof may be selected as appropriate based on the location of use of the structural body, the dimensions of the members of the structural body, and so on.

While the nut 16 is fastened until the joint device 14 is brought into close contact with the end face of the screw member 11 when the joint device 14 is secured to the screw member 11 by the nut 16 threadably mounted on the bolt 13, the joint device 14 may be secured after a larger tensile force is applied to elastically elongate the bolt 13. When the bolt 13 is fastened in this manner, a contact pressure is already applied between the end face of the screw member 11 and the upper surface of the joint device 14.

The joint device 14 has two horizontal plate portions facing each other and a side plate portion connecting the horizontal plate portions. The upper horizontal plate portion has a bolt hole, and is brought into contact with the end face of the screw member 11 threaded into the column 1. The bolt 13 is inserted through the bolt hole. The joint device 14 and the screw member 11 are coupled to each other by fastening the nut 16 threadably mounted on the bolt 13. The lower horizontal plate portion also has an opening. The joint device 14 is coupled to the foundation 3 by fastening a nut 15 threadably mounted on the anchor bolt 12 inserted through the opening with the horizontal plate portion facing the upper surface of the foundation 3.

The anchor bolt 12 is locked to the lower horizontal plate portion via a plate 14*a* so that the relative position between the anchor bolt 12 and the joint device 14 can be adjusted.

The joint structure is preferably set to fracture when the bolts 13 break to control the deformation amount at ultimate fracture. Thus, the member thickness and material of the joint devices 14 are preferably so selected that the joint devices 14 have sufficient strength and rigidity.

Figure 5B:
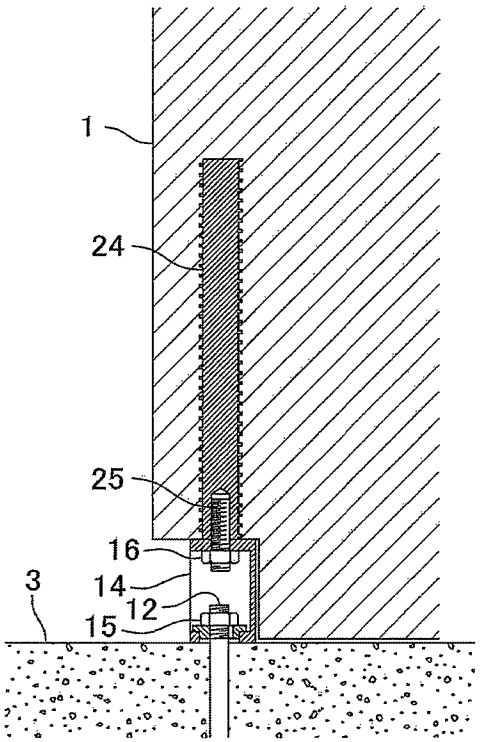
FIG. 5B shows a cross-sectional view illustrating an example in which a bolt with shorter length is used at the joint between the column and the foundation.
Figure 5A:
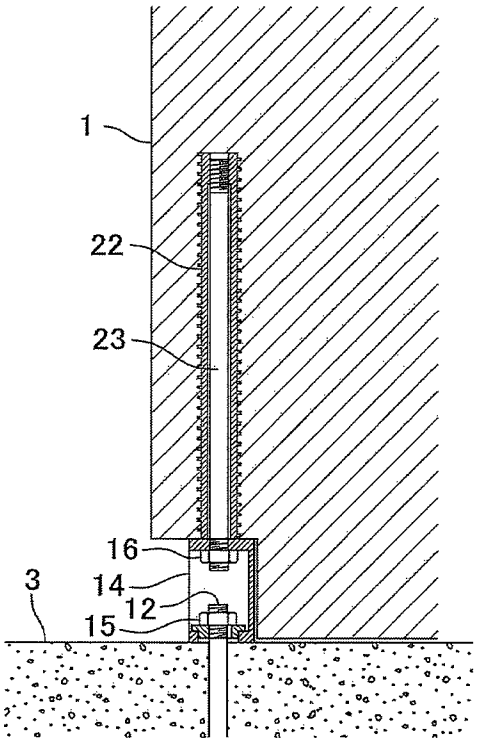
FIG. 5A shows a cross-sectional view illustrating an example in which a bolt with longer length is used at the joint between the column and the foundation.

The through holes of the screw members may be as deep as that of a screw member 22 shown in FIG. 5A so that long bolts 23 can be used, or as shallow as that of a screw member 24 shown in FIG. 5B so that short bolts 25 can be used. In this embodiment of the present invention, the depth of the through holes 11*b* and the length of the bolts 13 are set such that, when a relative displacement in the axial direction of the beam 2 between the beam 2 and the foundation 3, in other words, inter-story deflection occurs, the inter-story deflection which occurs before the column 1 is fractured is greater than the inter-story deflection which occurs before the load-bearing wall 4 or 5 is fractured by the effect of a horizontal force. The depth of the through holes 11*b* is approximately half the length of the screw members 11.

Because the tensile force from the bolt 13 is transferred to the screw member 11 at generally the longitudinal center of the screw member 11, the force transferred from the blade 11*a* of the screw member 11 to the wooden column 1 is widely distributed in the axial direction of the screw member 11 and stress is prevented from being concentrated on a wooden part. Thus, the bearing force of the screw member 11 against pulling-off is improved.

Figure 6:
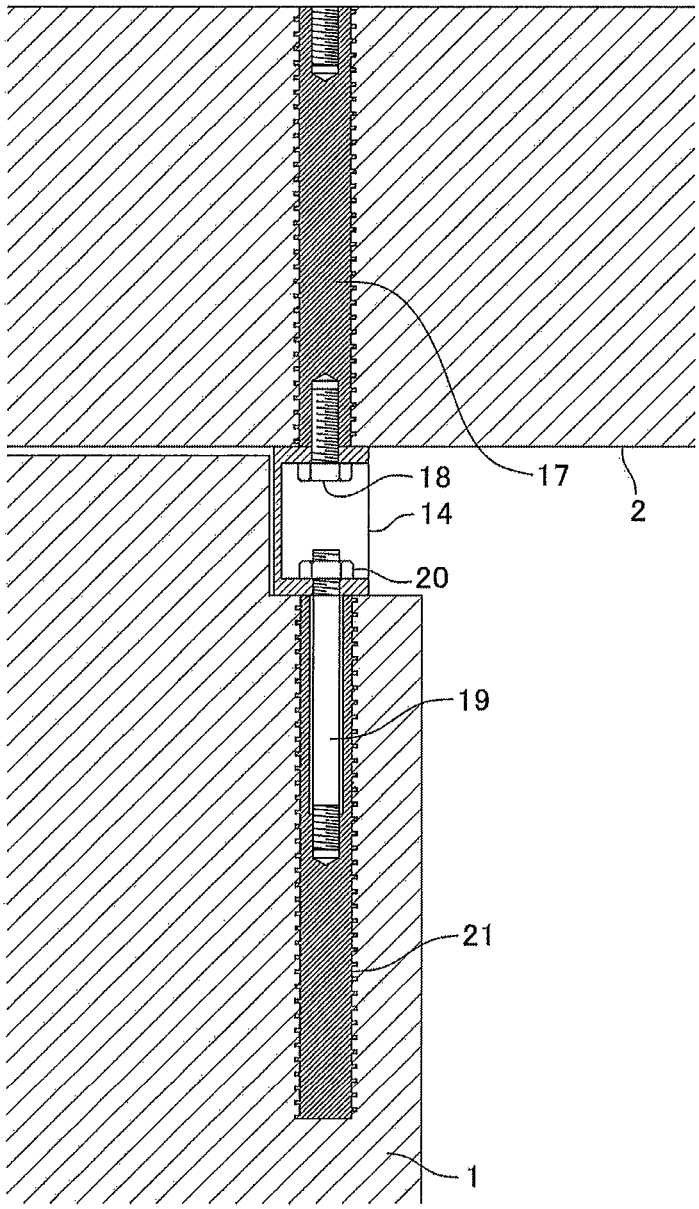
FIG. 6 is an enlarged cross-sectional view, illustrating the joint between the column and the beam in the wooden building skeleton shown in FIG. 1.

As shown in FIG. 6, the upper end of the column 1 and the beam 2 are joined to each other. Joint devices 14 are coupled to the column 1 by screw members 21, bolts 19 and nuts 20 as in the case of the lower end of the column 1. Screw members 17 for beam is vertically threaded into the beam 2 at positions corresponding to the joint devices 14, and each joint device 14 is coupled to the corresponding screw member 17 for beam by a bolt 18 threaded into a screw hole extending axially from the end face of the screw member 17.

Figure 7:
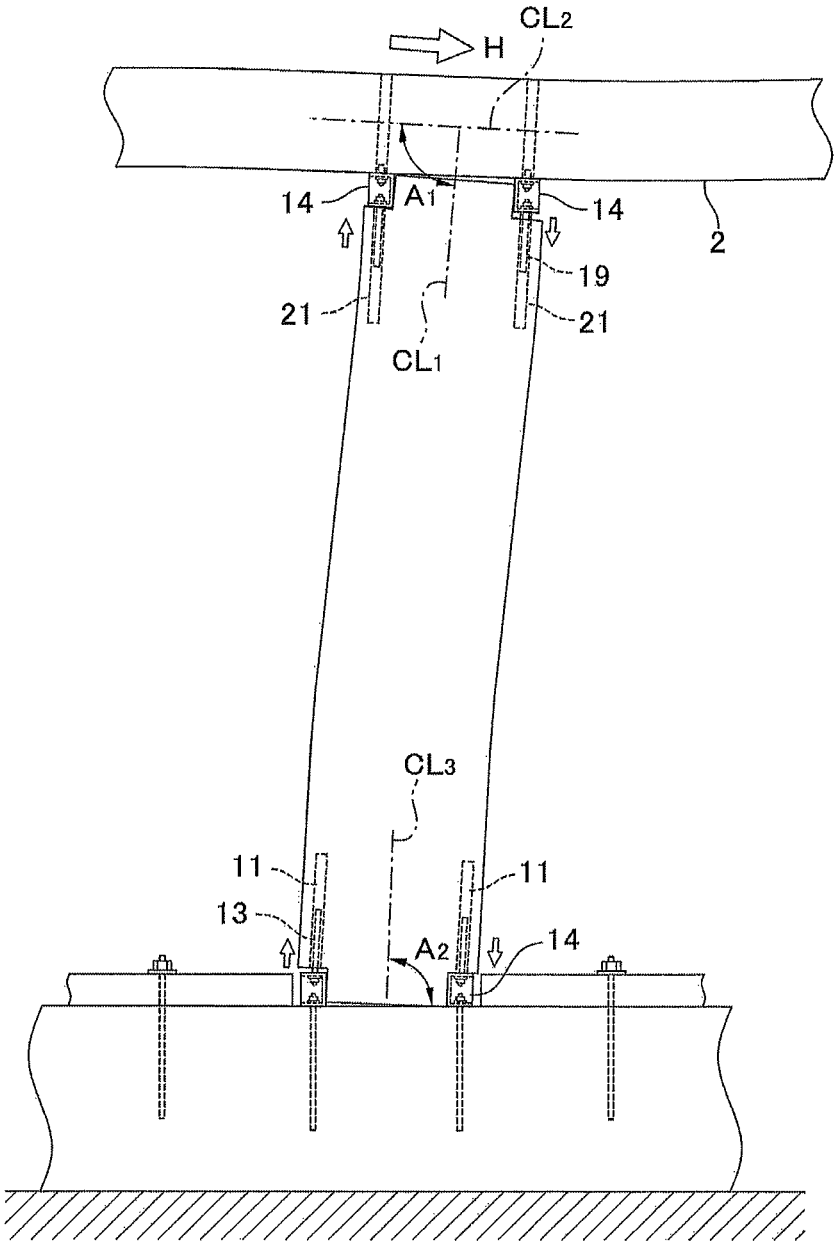

As shown in FIG. 6, the bolts 19 used to join the upper end of the column 1 to the beam 2 have a smaller outside diameter than the bolts 13, as shown in FIG. 3, that are used to join the lower end of the column 1 to the foundation 3. In this embodiment, the outside diameter of the portion which allows elongation between the male thread portions at both ends is 18.22 mm for the bolts 13 used to join the lower end of the column 1 to the foundation 3 and 16.22 mm for the bolts 19 used to join the upper end of the column 1 to the beam 2. Thus, as shown in FIG. 7, the change in angle $A_1$ between the axis $CL_1$ at the upper end of the column 1 and the axis $CL_2$ of the beam 2 is more likely to occur than the change in angle $A_2$ of the axis $CL_3$ of the column at the lower end of the column with respect to the horizontal direction. Thus, when an inclination angle is formed in the upper end of the column 1 by a horizontal force applied during an earthquake, the change in the angle of the joint prevents the beam 2 from tilting excessively. This prevents the beam 2 from receiving a large bending moment or the beam 2 from undergoing excessive deflection deformation.

While the outside diameter of the bolts 19 used at the upper end of the column 1 is smaller than that of the bolts 13 used at the lower end of the column 1 in this embodiment, the bolts used at the upper end of the column 1 is may be longer than the bolts used at the lower end of the column 1 so that the change in the angle at the joint can be likely to occur, or the bolts may have a smaller outside diameter and a larger length.

Figure 8:
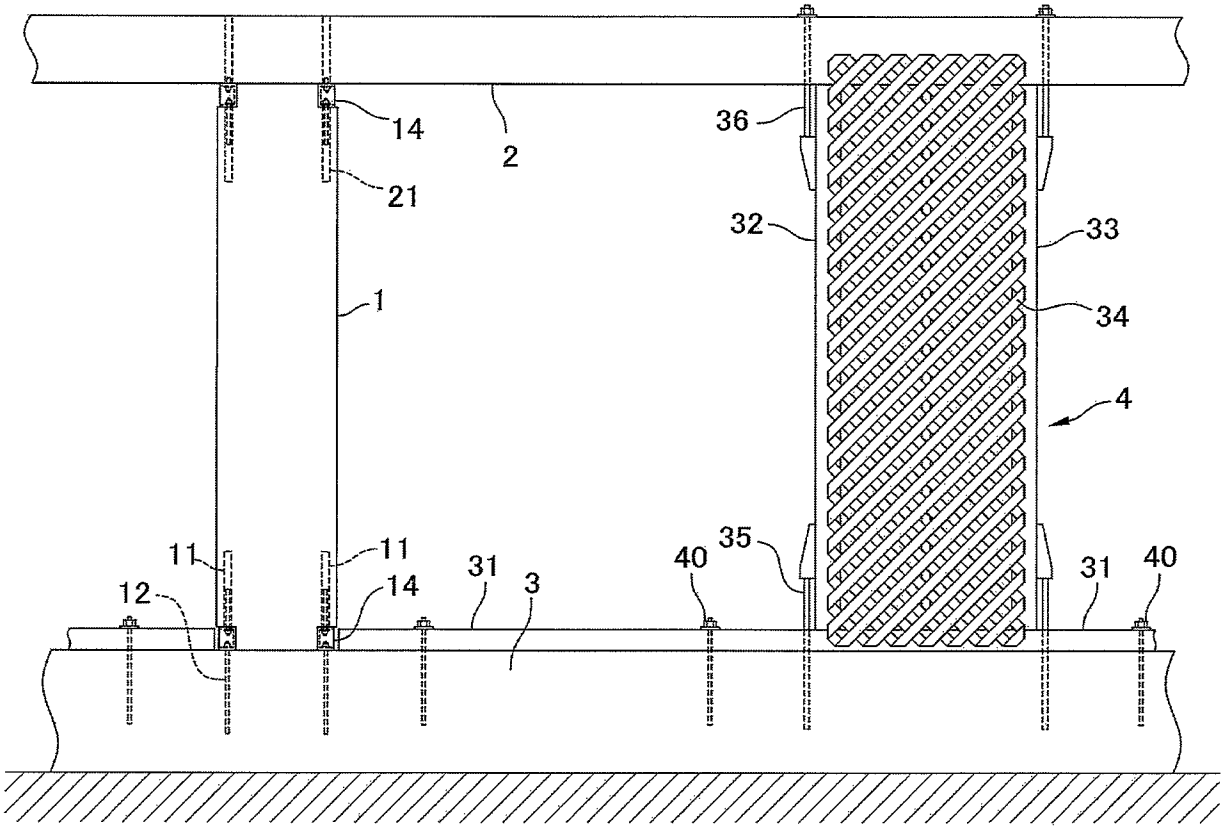
FIG. 8 is a partial side view, illustrating a rigid-frame structural body in which the same beam is supported by a column having a rigid-frame structure and a load-bearing wall.

FIG. 8 is a schematic side view illustrating a part of a rigid-frame structural body having a load-bearing wall 4 provided between the beam 2 and the foundation 3 in addition to the column 1 having a rigid-frame structure and capable of transferring and receiving a bending moment to and from the beam 2.

The load-bearing wall 4 has two shaft columns 32 and 33 erected on a base 31 provided on the foundation 3 to support the beam 2, and a panel-like member 34 secured between the shaft columns to constrain the shaft columns 32 and 33 from tilting. The shaft columns 32 and 33 have a square cross-section with generally the same side length as the short side of the cross-section of the beam 2. The shaft columns 32 and 33 are constrained from floating up from the base 31 by anchor bolts 35 having a lower end embedded in the foundation 3 but joined in such a way that a bending moment is hardly transferred between the shaft columns 32 and 33 and the foundation 3. While the upper end faces of the shaft columns 32 and 33 abut against the lower surface of the beam 2 and constrained from separating from the beam 2 by connecting bolts 36 vertically extending through the beam 2, but the shaft columns 32 and 33 are joined to the beam 2 in such a way that a bending moment is hardly transferred between the shaft columns 32 and 33 and the beam 2.

As shown in FIG. 9, the panel-like member 34 is a panel-like member formed by bonding a plurality of board members 34*a* having a predetermined width and obliquely arranged at predetermined intervals to a plurality of similar board members 34*b* tilted in the opposite direction. The four sides of the panel-like member 34 are attached to the two shaft columns 32 and 33, the beam 2 and the base 31 by means of nails 37 or screws, and deformation of the shaft columns 32 and 33 relative to the beam 2 and the base 31 are constrained by a compressive force or tensile force of the board members 34*a* and 34*b*. The wooden base 31 is secured to the foundation 3 by anchor bolts 40.

The gaps between the board members of the panel-like member 34 arranged parallel to each other serve as ventilation spaces and the spaces among the board members of the two board member groups stacked in layers are communicated to each other to form a vertical ventilation passage in the wall. Thus, the panel-like member 34 is used as a load-bearing wall 4 which is installed in an exterior wall part.

Figure 9A:
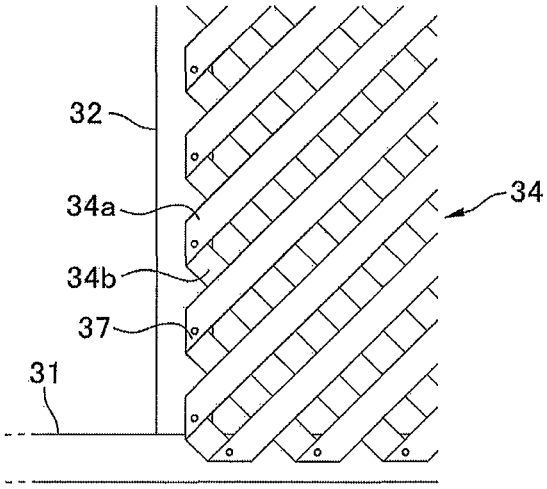
FIG. 9A is a schematic view illustrating the state in which a panel-like member which is also used in a load-bearing wall for an exterior wall portion shown in FIG. 8 is attached to a shaft column.
Figure 9B:
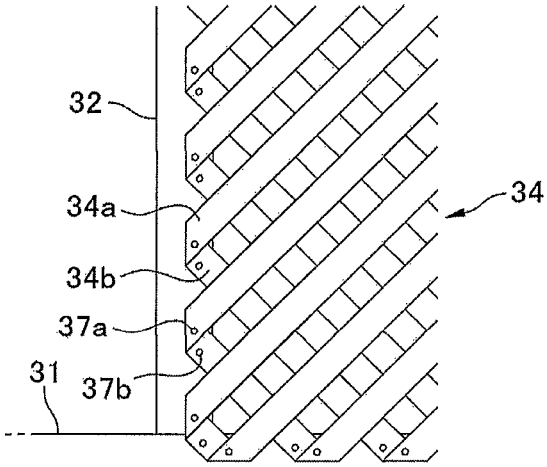
FIG. 9B is another schematic view illustrating the state in which a panel-like member which is also used in a load-bearing wall for an exterior wall portion shown in FIG. 8 is attached to a shaft column.

As shown in FIG. 9A and FIG. 9B the number of the nails 37 or screws used to attach the panel-like member 34 to the shaft columns 32 and 33, the beam 3 or the base 31 can be changed. As the number of the nail or screw is larger, displacement of the panel-like member 34 relative to the shaft columns 32 and 33 and so on is less likely to occur and the load-bearing wall 4 has higher rigidity.

Figure 10:
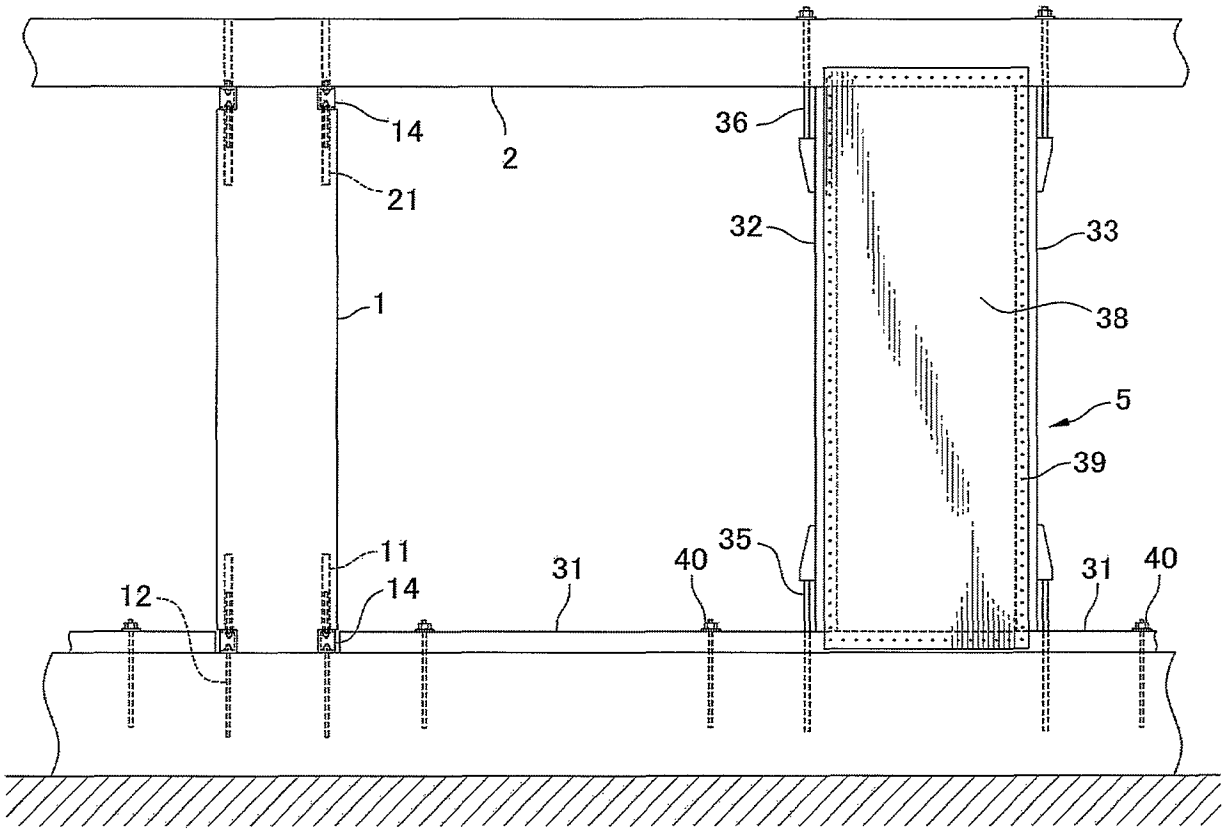
FIG. 10 is a partial side view, illustrating another example of a rigid-frame structural body in which the same beam is supported by a column having a rigid-frame structure and a load-bearing wall.

As shown in FIG. 10, in the case of a load-bearing wall 5 which is installed in a partition part, a single-piece board member 38, in place of the panel-like members 34, is preferably secured to the shaft columns 32 and 33, the beam 2 and the base 31 by means of nails 39 or screws. A structural plywood, slag plaster board (JIS A5430) or the like may be used as the board member 38.

Figure 11:
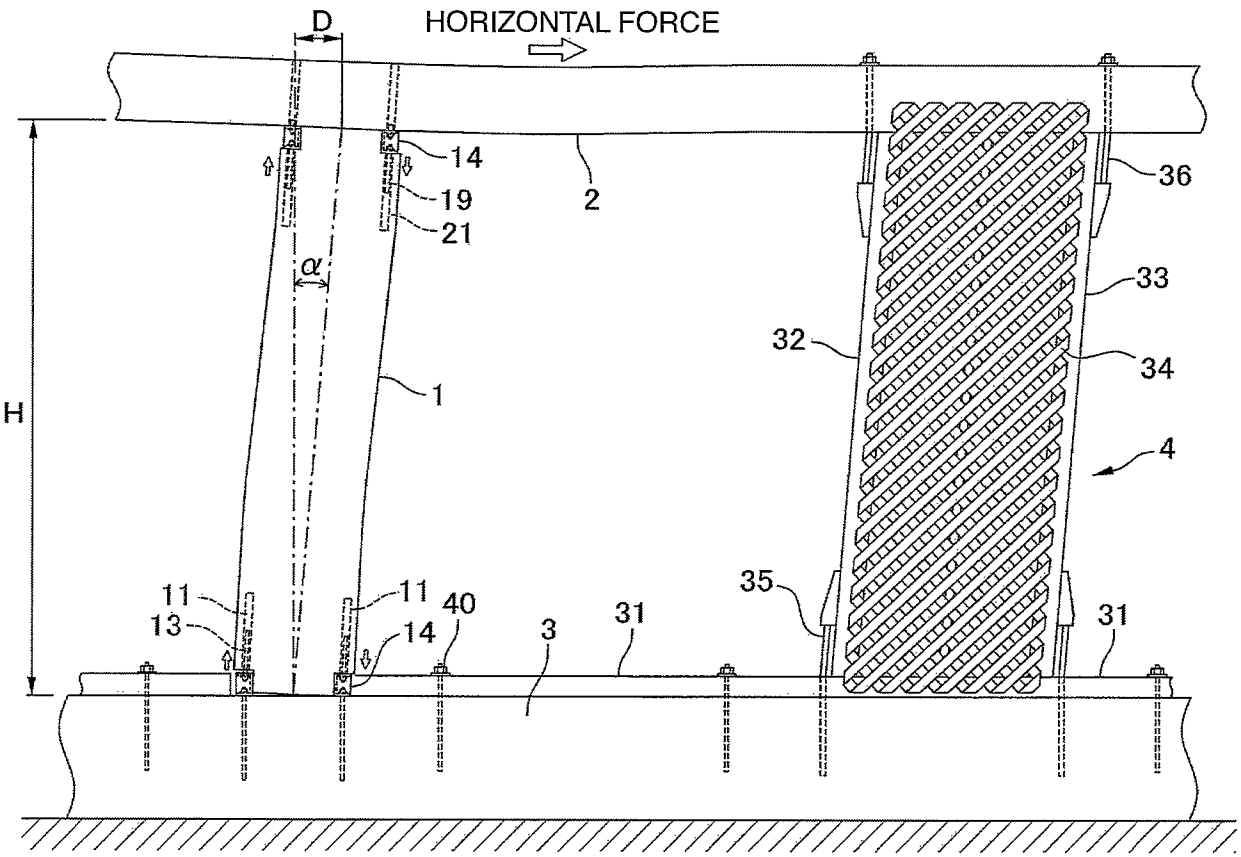
FIG. 11 is a schematic view, illustrating the state where inter-story deflection is generated by a horizontal force in the rigid-frame structural body shown in FIG. 8.
Figure 12:
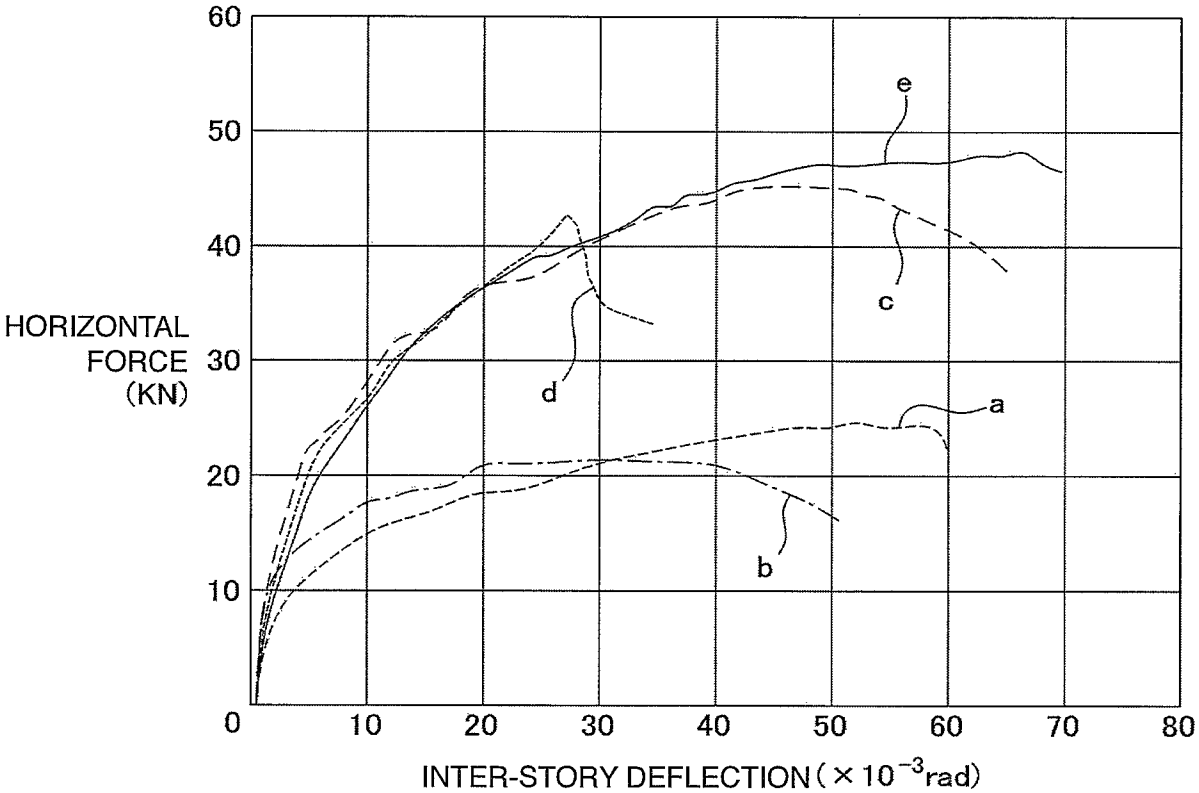
FIG. 12 is a graph, showing the relationship between a horizontal force applied to a column having a rigid-frame structure and a load-bearing wall and the inter-story deflection angle.

Referring to FIG. 11, such rigid-frame structural body, in which the column 1 having a rigid-frame structure and the load-bearing wall 4 or 5 are arranged to support one continuous beam 2 as described above deforms as shown when a horizontal force is applied thereto during an earthquake and both of the load bearing abilities of the column 1 having a rigid-frame structure and the load-bearing wall 4 resist the horizontal force. When displacement of the beam 2 in the axial direction relative to the foundation 3, in other words, inter-story deflection, occurs in this manner, the column 1 having a rigid-frame structure undergoes bending deformation. Thus, one of the two bolts 13 used to join the column 1 and the beam 2 at the joint therebetween and one of the two bolts 19 for the column 1 and the foundation 3 at the joint therebetween are elongated and an angle change occurs between the axis of the beam 2 at the joint and the axis of the upper end of the column 1 and between the axis of the lower end of the column and a horizontal line. On the other hand, in the load-bearing wall 4, it is considered that the board members 34*a* and 34*b* with a predetermined width forming the panel-like member 34 are elongated or contracted, and stress is concentrated on the board members 34*a* and 34*b* around the nails 37 or screws used to attached the board members 34*a* and 34 to the shaft columns 32 and 33, resulting in deformation of the board members 34*a* and 34*b* and displacement between the board members 34*a* and 34*b* and the shaft columns 32 and 33. Shown in FIG. 12 is the relationship between the inter-story deflection angle and the horizontal load during the process from deformation to fracture of the column 1 having a rigid-frame structure or the load-bearing wall 4.

The relationship, shown in FIG. 12, between the inter-story deflection angle and the horizontal load is obtained by an experiment, which is conducted as described below.

A specimen is prepared by electing a column having a rigid-frame structure on a support table and joining a beam to an upper part of the column in such a way that a bending moment can be transferred therebetween. The two shaft columns of a load-bearing wall are elected on a wooden member as a base fixed on the support table, and a beam is supported thereon. A panel-like member or single-piece board is secured to the wooden member as a base, the two shaft column and the beam to form a specimen. The specimens are a column having a rigid-frame structure and a load-bearing wall formed independently, and a horizontal force is repeatedly applied to the beam on the column or the beam on the load-bearing wall of each specimen. Then, the horizontal force and the axial displacement of the beam on the column or the load-bearing wall are measured and the inter-story deflection angle is calculated to investigate the relationship with the horizontal force, in other words, the horizontal load. Referring to FIG. 11 again, the inter-story deflection angle $\alpha$ is calculated from the axial displacement D of the beam and the height H of the column or the load-bearing wall according to the following formula:

$$\tan \alpha = D/H$$

The curve a in FIG. 12 shows the relationship between the horizontal load on the load-bearing wall constituted using the panel-like member 34 formed of a plurality of board members with a predetermined width arranged obliquely as shown in FIG. 8 and FIG. 9A and the inter-story deflection angle. In the panel-like member 34, as shown in FIG. 9A, the board members are attached to the shaft column 32 by means of the nails 37 or screws at locations where two boards inclined in the opposite directions are overlapped. The curve b shows the relationship between the horizontal load on the load-bearing wall using a slag plaster board (Tough Panel, manufactured by Sumitomo Forestry Co., Ltd.) as a board member and the inter-story deflection angle. These load-bearing walls undergo elastic displacement when a horizontal force starts to be applied and then undergo plastic deformation. At this time, an inter-story deflection angle of approximately $50\times10^{-3}$ rad to $60\times10^{-3}$ rad is formed before fracture.

When the number of nails or screws used to attach the panel-like member 34 to the shaft column 32 is increased not only to attach the board members to the shaft column 32 by means of nails 37*a* or screws at locations where two board members inclined in the opposite directions are overlapped as shown in FIG. 9B but also to attach one of the two overlapped board members with a predetermined width to the shaft column 32 by means of a nail 37*b* or screw, the load bearing ability against a horizontal force significantly increases as indicated by the curve c in FIG. 12. In addition, because the initial rigidity, in other words, the rigidity within the range where deformation occurs almost elastically increases, deformation is less likely to occur. In other words, the displacement of the beam is smaller compared to that of the load-bearing wall with the smaller number of nails or screws as shown in FIG. 9A when the same horizontal force is applied. It should be noted that even when the number of the nails 37 or screws is increased, the inter-story deflection angle which is generated before fracture does not significantly change.

On the other hand, when the short bolts 24 are used as shown in FIG. 5B, as the bolts threaded into the screw members 23 to couple the joint devices 14 to the column at the joint between a column having a rigid-frame structure and the foundation and at the joint between the column and the beam, the relationship between the horizontal load and the inter-story deflection angle is as shown by the curve d in FIG. 12. The column having a rigid-frame structure provides an inter-story deflection angle of approximately $30\times10^{-3}$ rad before fracture, which is smaller than that provided by the load-bearing walls.

In contrast, as shown in FIG. 3 and FIG. 6, in the case of a column in which the through holes in the screw members are deepened to use long bolts 13 which are threaded into the screw members 11 at a position at approximately half the axial length of the screw members 11, the relationship between the horizontal load and the inter-story deflection angle is as shown by curve e in FIG. 12. Specifically, the load bearing ability does not significantly change but the inter-story deflection angle which is generated before fracture increases to be almost equal to or greater than the inter-story deflection angle provided by the load-bearing walls. The bolts 13 used in this case have a length of approximately 140 mm from the male thread portion which is threaded in the through hole to the male thread portion on which the nut is threadably mounted.

While it is believed that the inter-story deflection angle that is generated before the load-bearing wall 4 or 5 is fractured depends on the rigidity, thickness, manner of attachment and so on of the panel-like member 34 or the board 38 used in the load-bearing wall, the inter-story deflection angle which is generated before the column 1 is fractured can be adjusted by properly setting the length of the bolts 13 or 19 used at the joint between the column 1 having a rigid-frame structure and the foundation 3 and the joint between the column 1 and the beam 2 and can be greater than the inter-story deflection angle that the load-bearing wall 4 or 5 undergoes. In addition, while the column having a rigid-frame structure has cross-section dimensions of 105 mm×560 mm in the above experiment, there is a possibility that the inter-story deflection before fracture can be adjusted by using a column with a different long side length.

Because the inter-story displacement angle before the column 1 having a rigid-frame structure is fractured and the inter-story deflection angle before the load-bearing wall 4 or 5 is fractured are almost equal to each other as described above, when a horizontal force is repeatedly applied to the rigid-frame structural body during an earthquake, the column 1 having a rigid-frame structure and the load-bearing walls 4 and 5 resist the horizontal force in conjunction with each other. Then, because the energy of earthquake motion is absorbed by plastic deformation of the column 1 and the load-bearing walls 4 and 5, the safety against ultimate fracture can be maintained at a high level. In other words, when the amount of inter-story deflection which is generated before the column 1 having a rigid-frame structure is fractured is smaller as shown by curve d in FIG. 12 than the amount of inter-story deflection which the load-bearing wall 4 or 5 undergoes, the load bearing ability of the column 1 having a rigid-frame structure is lost when the rigid-frame structural body is deformed greater than the amount of inter-story deflection allowed by the column 1. As a result, the ability to absorb the energy of earthquake motion decreases and the safety against fracture is impaired because load is concentrated on the load-bearing walls 4 and 5. In contrast, the capacity to absorb energy of earthquake motion can be increased to improve the safety of the rigid-frame structural body against ultimate fracture by adjusting the amount of inter-story deflection before the column 1 having a rigid-frame structure is fractured.

On the other hand, in this embodiment, the load bearing ability of the load-bearing wall 4 against a horizontal force is adjusted to be comparable to that of the column 1 having a rigid-frame structure by setting, as shown in FIG. 9B, the number of nails 37 or screws used to attach the panel-like member 34 of the load-bearing wall formed by obliquely arranging a plurality of boards with a predetermined width to the shaft columns, the beam and the base. Therefore, when a horizontal force causes a plastic deformation of the load-bearing wall 4 and the column 1 having a rigid-frame structure, the load-bearing wall 4 and the column support an equivalent amount of horizontal force and the horizontal force can be prevented from being concentrated on either the load-bearing wall 4 or the column 1 having a rigid-frame structure.

The structure by which the column having a rigid-frame structure is joined to the beam or foundation can allow, in addition to the adjustment of the amount of inter-story deflection before fracture by adjusting the length of the bolts 13 or 19, the adjustment of the initial rigidity and the load bearing ability (ultimate strength) of the column by adjusting the diameter of the bolts. In addition, the yield point and the load bearing ability of the bolts with a set diameter can be adjusted by selecting the material of the bolts. Thus, by comprehensively adjusting the length, diameter and material of the bolts, the relationship between the horizontal load and the amount of inter-story deflection can be adjusted depending on the structure of the load-bearing wall used in combination so that the curves of the relationship between the horizontal load and the amount of inter-story deflection can have substantially the same shape, for example.

Figure 13:
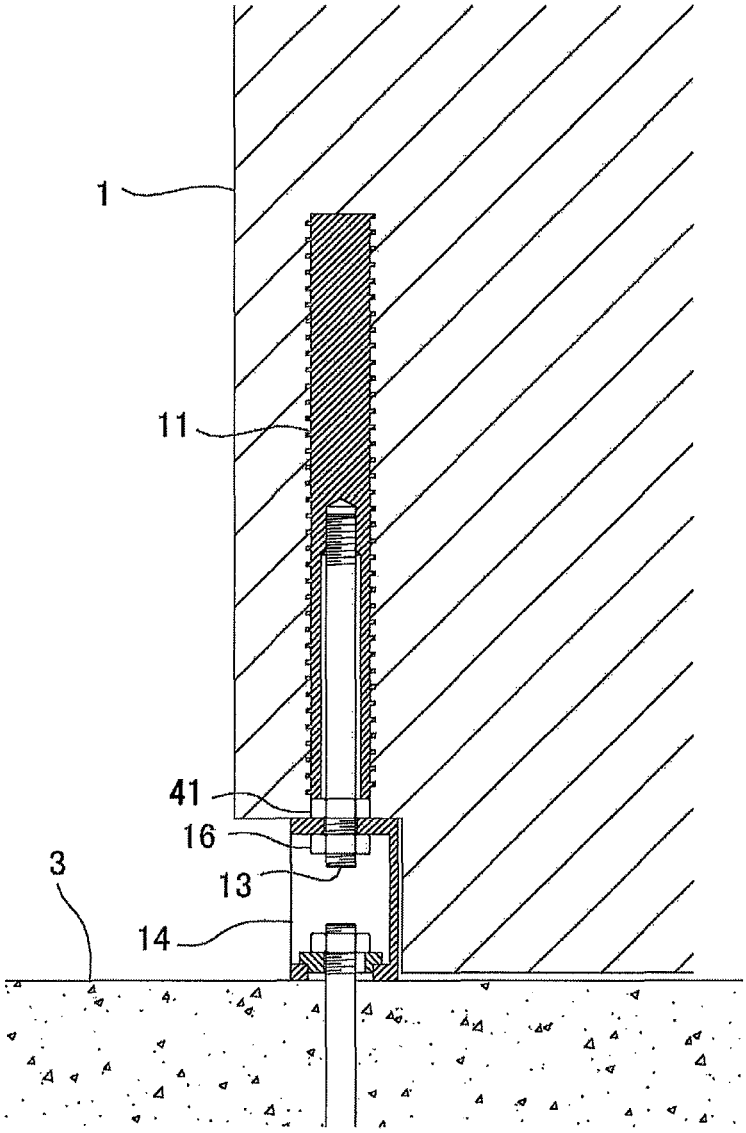
FIG. 13 is a cross-sectional view, illustrating another example of a structure by which a column having a rigid-frame structure and a foundation are joined to each other.

The joint structure between the column 1 having a rigid-frame structure and the foundation 3 or the beam 2 may be a structure as shown in FIG. 13 in place of the structure shown in FIG. 3 or FIG. 6.

While the same screw member 11, bolt 13, nut 16 and joint device 14 as those used in the joint structure shown in FIG. 3 are used in this joint structure, an intermediate nut 41 is used between the screw member 11 and the joint device 14. The intermediate nut 41 is threadably mounted on a distal portion of the bolt 13 inserted into the through hole of the screw member 11 and threaded into the female thread portion of the screw member 11 and is in pressure contact with the end face of the screw member 11. The horizontal plate portion of the joint device 14 is interposed and secured between the intermediate nut 41 and the nut 16 threadably mounted onto the bolt 13 from the distal end thereof.

The joint structure has the following effects in addition to the same function of connecting the column 1 and the joint device 14 as the joint structure shown in FIG. 3.

Figure 14B:
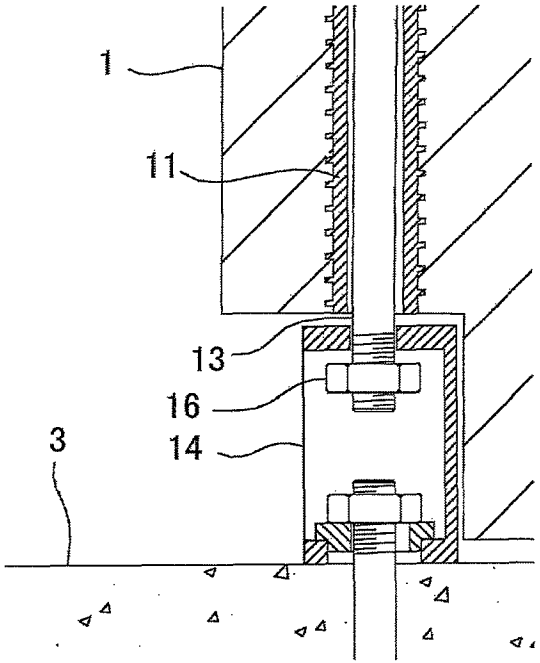
FIG. 14B is a schematic view illustrating the function of the joint structure different from the one shown in FIG. 13.
Figure 14A:
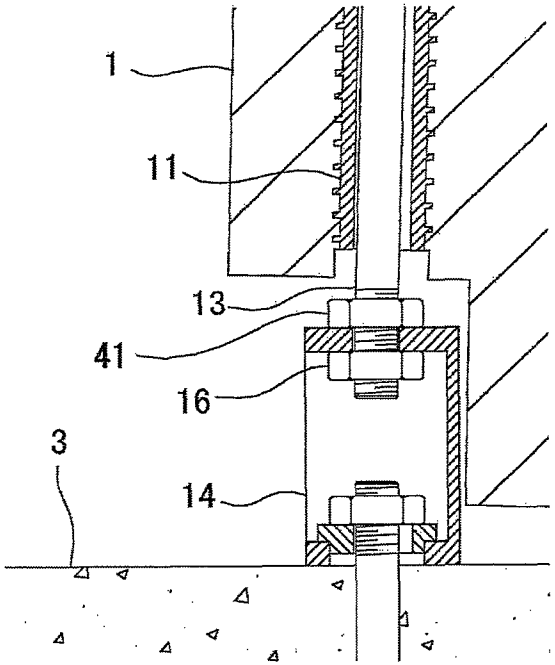
FIG. 14A is a schematic view illustrating the function of the joint structure shown in FIG. 13.

When the bolt 13 undergoes tensile stress by a large bending moment which acts on the lower end of the column 1 and then a bending moment in the opposite direction is generated after the bolt 13 undergoes plastic deformation during an earthquake, the joint device 14 is held, as shown in FIG. 14A, sandwiched between the intermediate nut 41 and the nut 16 and applies compressive stress to the bolt 13. In other words, the joint device 14 acts to push the bolt 13 having an end fixedly threaded into the female thread into the through hole. Then, plastic deformation in the compression direction is generated and the joint device 14 returns to the original position. Along with this, a tensile force is applied to the bolt used on the opposite side of the cross-section of the column. Such deformation is repeated by vibration during an earthquake.

In contrast, as shown in FIG. 14B, when the intermediate nut 41 is not used, because the joint device 14 returns to the original position while the plastic deformation of the bolt 13 still remains, the bolt 13 is deformed without resisting a bending moment in the opposite direction in this range and the capacity to absorb energy of earthquake motion decreases. Thus, the use of the intermediate nut 41 increases the capacity to absorb energy of earthquake motion and is effective in attenuating the vibration effectively.

The intermediate nut 41 may be preliminarily secured to the bolt. In other words, a bolt having a flange-like protrusion which functions in the same manner as the intermediate nut 41 may be used.

While the inter-story deflection between the foundation 3 and the beam 2 of the lower story which is generated before the column 1 having a rigid-frame structure is fractured is adjusted to be almost equal to or greater than the inter-story deflection which is generated before the load-bearing wall 4 is fractured in the embodiment described above, the column having a rigid-frame structure and the load-bearing wall which are provided between the beam 2 of the lower story and the beam 6 of the upper story may have the same structure.

In addition, the present invention is not limited to the embodiment described above, and may be implemented in different forms within the scope of the present invention.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

DESCRIPTION OF REFERENCE NUMERALS AND SYMBOLS

1: column
1*a*, 1*b*: cutout
2: beam
3: foundation
4, 5: load-bearing wall
6: column of upper story
7: beam of upper story
11: screw member
11*a*: protrusion
11*b*: (hollow) through hole
11*c*: female thread
12: anchor bolt
13: bolt
14: joint device
15, 16: nut
17: screw member for beam
18: bolt
19: bolt
20: nut
21: screw member
22, 24: screw member
23, 25: bolt
31: base
32, 33: shaft column
34: panel-like member
35: anchor bolt
36: connecting bolt
37: screw
38: board member
39: screw
40: anchor bolt
41: intermediate nut

What is claimed is:

1. A wooden building skeleton, comprising:

a wooden column erected on a foundation or a beam of a lower story, the wooden column having a flat rectangular cross-section;

a wooden beam joined to the wooden column with a lower surface thereof facing an upper surface of the wooden column, the wooden beam having an axis extending in a direction of a longitudinal axis of a cross-section of the wooden column; and a load-bearing wall having two shaft columns erected at a predetermined distance on the foundation or the beam of the lower story for supporting the wooden beam by an axial force, and a board member or a plurality of board members secured to the shaft columns, each of the plurality of board members having a predetermined width and being secured to the shaft columns at a first end and a second end of each of the plurality of board members and arranged obliquely between the shaft columns;

wherein the wooden column has a lower end joined to the foundation or the beam of the lower story via two first bolts, wherein the two first bolts are positioned vertically in a vicinity of a first end and a second end of a cross-section of the lower end of the wooden column, wherein the first end and the second end of the cross-section of the lower end of the wooden column are positioned in a direction of a longitudinal axis of the cross section of the lower end of the wooden column in such a way that a bending moment is transferred from the wooden column to the foundation or the beam of the lower story;

wherein the wooden column and the wooden beam are joined to each other via two second bolts positioned vertically in a vicinity of both a first end and a second end of a cross-section of an upper end of the wooden column, wherein the first end and the second end of the cross-section of the upper end of the wooden column are positioned in a direction of a longitudinal axis of the cross-section of the upper end of the wooden column in such a way that a bending moment is transferred between the wooden beam and the wooden column; and wherein a length of a portion of each of the first bolts, a length of a portion of each of the second bolts, and a length of the wooden column in the direction of the longitudinal axis of the cross-section of the wooden column are set such that a first relative displacement between the wooden beam and the foundation or the beam of the lower story, which is generated before the wooden column is fractured, is equal to or greater than a second relative displacement between the wooden beam and the foundation or the beam of the lower story, which is generated before the load-bearing wall is fractured, wherein the portion of each of the first bolts and the portion of each of the second bolts undergo elongation when the first and second relative displacements are generated between the wooden beam and the foundation or the beam of the lower story, wherein the portion of each of the first bolts and the portion of each of the second bolts are located where the elongation is respectively generated when the first and second relative displacements are generated.

2. The wooden building skeleton according to claim 1, wherein the second bolts are for joining an upper end of the wooden column and the wooden beam, and the first bolts are for joining the lower end of the wooden column and the foundation, wherein the section which undergoes elongation of the second bolts is set to have a longer length or smaller diameter than the section which undergoes elongation of the first bolts.

3. The wooden building skeleton according to claim 2, further comprising screw members, each of the screw members having a spiral blade on a cylindrical outer periphery thereof, are axially threaded into the upper end and the lower end of the wooden column at locations in the vicinity of the first end and the second end of the cross-section of the lower end of the wooden column and in the vicinity of the first end and the second end of the cross-section of the upper end of the wooden column, respectively;

each of the screw members has a hole axially extending from an end face thereof;

each of the first bolts and the second bolts is inserted into the hole and each of the bolts has a proximal end threadedly engaged with a female thread formed in a vicinity of the bottom of the hole;

each of the first bolts and the second bolts has a distal end engaged with a joint device secured to the foundation or the beam of the lower story or a joint device secured to the wooden beam;

each of the first bolts and the second bolts undergoes the elongation between the distal end and the proximal end threadedly engaged with the female thread in the hole; and the female thread with which the proximal end of each of the first bolts and the second bolts is threadedly engaged is located at approximately half an axial length of each of the screw members.

4. The wooden building skeleton according to claim 2, wherein a number of nails or screws used to fix the board member or the plurality of obliquely-arranged board members with a predetermined width of the load-bearing wall to the shaft columns is set such that the load-bearing wall has an equivalent load bearing ability as the wooden column when the first relative displacement is generated between the wooden beam and the foundation or the beam of the lower story.

5. The wooden building skeleton according to claim 1, further comprising screw members, each of the screw members having a spiral blade on a cylindrical outer periphery thereof, are axially threaded into the upper end and the lower end of the wooden column at locations in the vicinity of the first end and the second end of the cross-section of the lower end of the wooden column and in the vicinity of the first end and the second end of the cross-section of the upper end of the wooden column, respectively;

each of the screw members has a hole axially extending from an end face thereof; each of the first bolts and the second bolts is inserted into the hole and each of the bolts has a proximal end threadedly engaged with a female thread formed in a vicinity of the bottom of the hole;

each of the first bolts and the second bolts has a distal end engaged with a joint device secured to the foundation or the beam of the lower story or a joint device secured to the wooden beam;

each of the first bolts and the second bolts undergoes the elongation between the distal end and the proximal end threadedly engaged with the female thread in the hole; and the female thread with which the proximal end of each of the first bolts and the second bolts is threadedly engaged is located at approximately half an axial length of each of the screw members.

6. The wooden building skeleton according to claim 5, wherein a number of nails or screws used to fix the board member or the plurality of obliquely-arranged board members with a predetermined width of the load-bearing wall to the shaft columns is set such that the load-bearing wall has an equivalent load bearing ability as the wooden column when the first relative displacement is generated between the wooden beam and the foundation or the beam of the lower story.

7. The wooden building skeleton according to claim 1, wherein a number of nails or screws used to fix the board member or the plurality of obliquely-arranged board members with a predetermined width of the load-bearing wall to the shaft columns is set such that the load-bearing wall has an equivalent load bearing ability as the wooden column when the first relative displacement is generated between the wooden beam and the foundation or the beam of the lower story.

* * * * *